US005617767A

United States Patent [19]

Nikoden

[11] Patent Number: 5,617,767

[45] Date of Patent: Apr. 8, 1997

[54] EXTRACTOR TOOL

[76] Inventor: James Nikoden, 1502 4th St.-#2, P.O. Box 1546, Berthoud, Colo. 80513

[21] Appl. No.: 564,907

[22] Filed: Nov. 29, 1995

[51] Int. Cl.[6] ..... B25B 33/00

[52] U.S. Cl. ..... 81/488; 81/486; 29/259

[58] Field of Search ..... 29/259, 361; 81/485, 81/486, 488

[56] References Cited

U.S. PATENT DOCUMENTS 2,713,278 7/1955 Stump .

4,108,026 8/1978 Anderson et al. .

*Primary Examiner*—James G. Smith

*Attorney, Agent, or Firm*—Dean P. Edmundson

[57] ABSTRACT

An extractor tool for manually loosening and extracting a climber's camming device from a crevice in a rock, for example. The tool includes a barrel having one or more hooks on one end and a plunger within the barrel. The tool can be attached to the handle of a camming device within a crevice and the plunger can be operated so as to cause the cams of the camming device to become retracted to thereby free the camming device from the crevice.

12 Claims, 2 Drawing Sheets

EXTRACTOR TOOL

FIELD OF THE INVENTION

This invention relates to climbing aids. More particularly, this invention relates to tools and aids which are useful for extracting camming devices which have become wedged in crevices of rocks, etc.

BACKGROUND OF THE INVENTION

Camming or wedging devices are often used by climbers to create anchors or otherwise support climbing aids in crevices or small openings in a rock, for example. Such camming devices are well known in the field and are commonly used. Typically they include a handle and one or more pivotable cams which are biased to an extended or outward position by springs. A release rod is manually movable axially with respect to the handle so as to move the cams from their extended position to a retracted position. A camming device of this type is described, for example, in U.S. Pat. No. 4,645,149, incor-porated herein by reference. Other climbing aids, chocks, pitons, etc. are described in U.S. Pat. Nos. 4,184,657; 4,572,464; 4,715,568; and 4,834,327.

Sometimes a camming device becomes wedged in a crevice so deeply that it is difficult or impossible for a climber to reach the device or to manipulate the release rod to allow the device to be extracted from the crevice. Consequently, a camming device may have to be abandoned in the crevice when it cannot be removed.

Because a camming device of this type is fairly expensive, it can be costly to simply abandon it in the crevice. Also, abandoning a camming device limits a climber's later activities where such device may be needed.

Although U.S. Pat. No. 4,108,026 describes a one-piece tool for removing rock climbing tools, such tool is not adapted to simple and effective removal of camming devices. U.S. Pat. No. 2,713,278 describes an automobile forcible entry tool but it would not be suitable for removing lodged camming devices from rocks or other crevices.

There has not heretofore been described an exterior tool for manually extracting a climber's camming device from a crevice which has the advantages and unique features as provided by the tool of the present invention.

SUMMARY OF THE PRESENT INVENTION

In accordance with the present invention there is provided an extractor tool for manually extracting a climber's camming device from a crevice. A typical camming device has a handle and one or more cams carried by the handle which are movable between extended and retracted positions by movement of a release rod axially relative to the longitudinal axis of the handle.

In a preferred embodiment the extractor tool comprises:

(a) an elongated barrel member having first and second ends and a longitudinal bore therethrough; the barrel member further includes finger grip means;

(b) a plunger member axially movable in the barrel member, the plunger member including a first end adjacent to the first end of the barrel member and a second end projecting outwardly from the second end of the barrel member;

(c) hook means carried by the second end of the barrel member for connection to the release rod of the camming device.

The extractor tool is designed to connect to a climber's camming device which has become lodged or wedged in a rock crevice or the like. The hook means is hooked onto the release rod of the camming device, and the plunger member is axially aligned with the handle of the camming device. When the plunger member is urged against the outer end of the handle of the camming device, the cam (or cams) of the camming device are caused to be retracted by axial movement of the release rod, thereby freeing the camming device from the rock crevice.

Thus, the extractor tool operates as an extension of the handle of the camming device which enables the camming device to be operated as it was intended. No modification of the camming device is required.

Use of the extractor tool of the invention eliminates the frustration and extreme physical exertion associated with attempting to retrieve a camming device from a deep crevice in a rock, for example.

Other advantages of the extractor tool will become apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
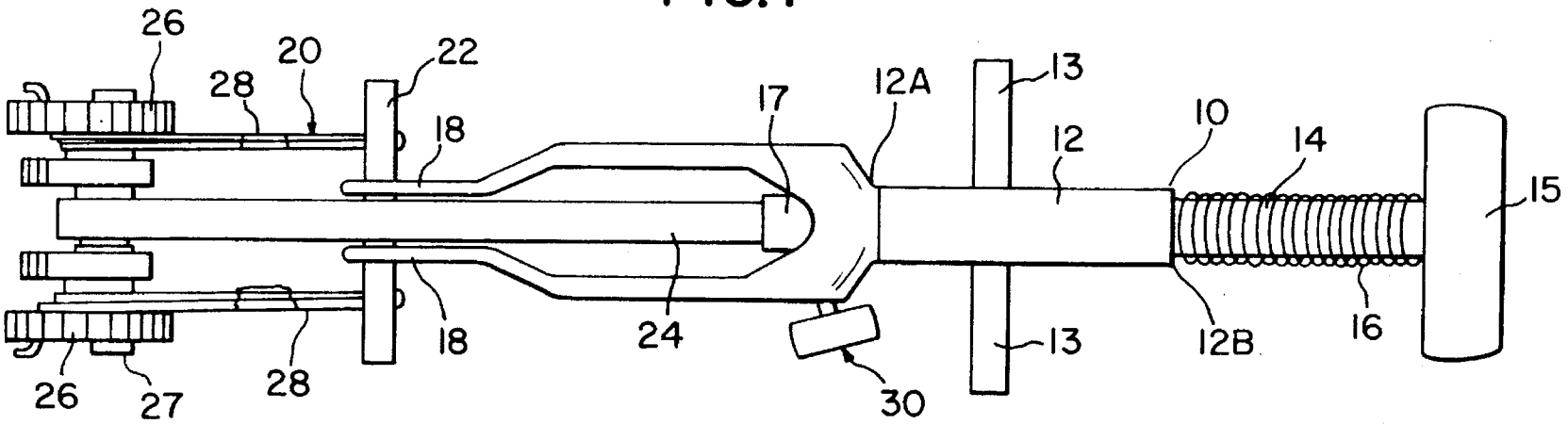
FIG. 1 is a top view of a preferred embodiment of extractor tool of the invention shown as attached or connected to a conventional camming device.

In the drawings there is shown an extractor tool 10 of the invention comprising an elongated barrel member 12 having a first end 12A and an outer or second end 12B. There is a longitudinal bore through the length of the barrel for slidably receiving a plunger member 14. The outer end of the plunger is fitted with an enlarged cap or button 15.

A coiled spring 16 is positioned around the plunger between the outer end of the barrel and the button 15. The spring biases the plunger axially outward relative to the longitudinal axis of the barrel.

The opposite end 17 of the plunger is adjacent the inner end 12A of the barrel. Extending downwardly from the lower end of the barrel are hook means 18. Preferably there are two such hooks of comparable size and shape which include receiving openings for engaging the release rod 22 on opposite sides of a camming device 20. The camming device includes an elongated handle 24. The release rod 22 extends through a slotted aperture 24A in the handle and is axially movable relative to the handle in the slotted aperture.

Figure 2:
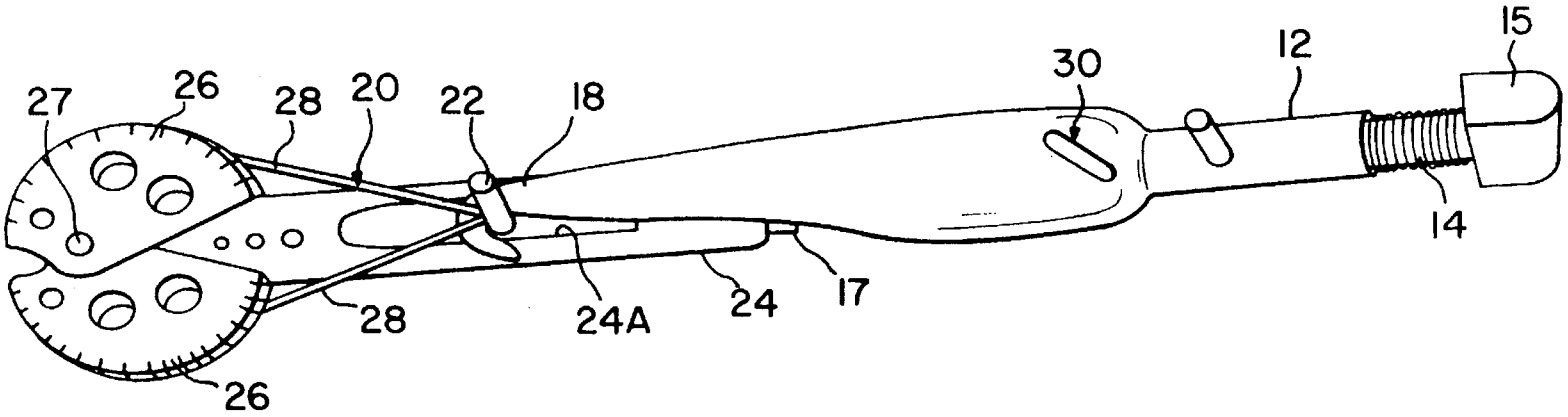
FIG. 2 is a side elevational view of the extractor tool and camming device shown in FIG. 1, with the cams of the camming device in a partially-retracted position.
Figure 3:
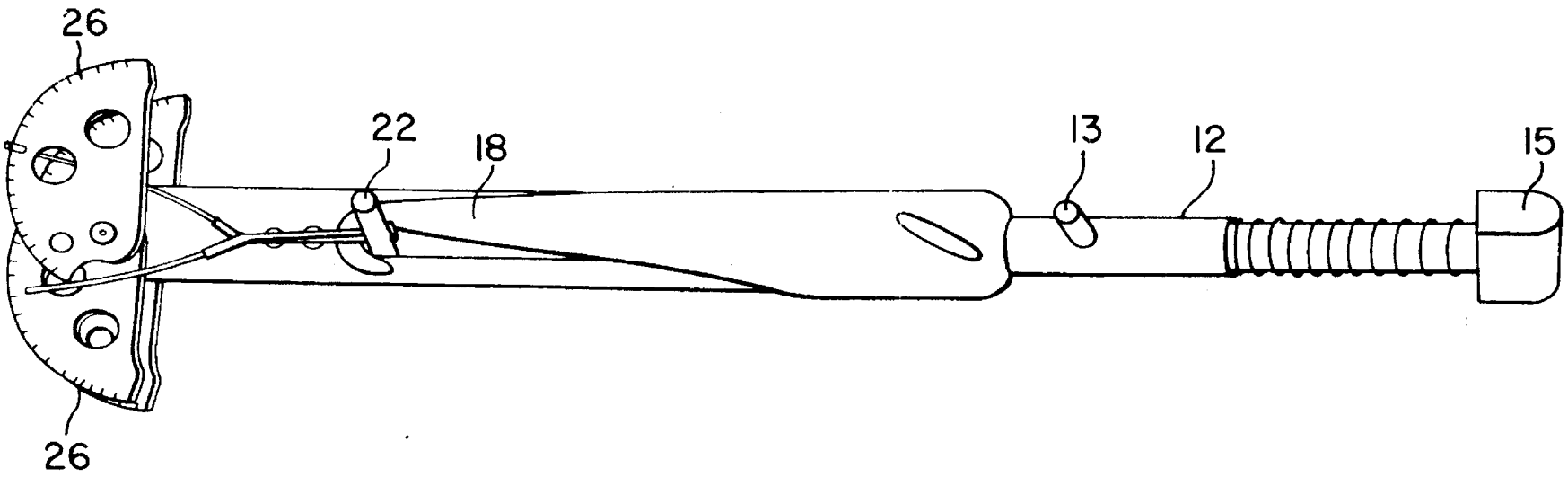
FIG. 3 is a side elevational view of the extractor tool and camming device with the cams in their extended position.

Cams 26 are pivotably mounted to handle 24 by means of pin 27. Each cam is connected to the release rod by means of a cable 28. When rod 22 is urged toward the outer end of handle 24 the cables 28 cause the cams to be pivoted from their extended position (FIG. 3) to their retracted position (partial retraction shown in FIG. 2). Springs bias the cams to their extended position.

Barrel 12 of the exterior tool further includes finger grip means 13 extending outwardly from each side of the barrel about mid-way along the length of the barrel. After the extractor tool has been attached to the camming device (shown in FIG. 1) the plunger 14 is urged against the handle 24 by grasping finger grips 13 with two fingers and pushing against button 15 with the thumb. This causes the release rod 22 to be moved axially toward the outer end of the handle to retract the cams 26 of the camming device.

If desired, a lock means can be included in the extractor tool to lock the plunger 14 in any desired axial position relative to the longitudinal axis of the barrel 12. For example, the lock means may comprise a threaded bolt or screw 30 which extends through a threaded bore through the side wall of the lower end of the barrel. The inner end of the bolt can be forced against the plunger 14 (by rotating the head of the bolt 30) to frictionally engage the plunger and prevent it from moving axially.

Other variants are possible without departing from the scope of this invention.

What is claimed is:

1. An extractor tool for manually extracting a climber's camming device from a crevice, wherein the camming device is of the type having a handle and one or more cams carried by the handle which are movable between extended and retracted positions by movement of a release rod axially relative to the longitudinal axis of said handle; wherein said extractor tool comprises:

(a) an elongated barrel member having first and second ends and a longitudinal bore therethrough; said barrel member further including finger grip means;

(b) a plunger member axially movable in said barrel member, said plunger member including a first end adjacent said first end of said barrel member and a second end projecting outwardly from said second end of said barrel member;

(c) a pair of arms, each of said arms including hook means, carried by said second end of said barrel member for connection to said release rod of said camming device.

2. An extractor tool in accordance with claim 1, wherein said plunger member is biased in the direction of said second end of said barrel member.

3. An extractor tool in accordance with claim 1, wherein said finger grip means comprises a shaft secured to said barrel member between said first and second ends thereof and being perpendicular to said barrel member.

4. An extractor tool in accordance with claim 1, wherein said hook means is in alignment with the longitudinal axis of said plunger member.

5. An extractor tool in accordance with claim 2, wherein said plunger member is biased by means of a spring.

6. An extractor tool in accordance with claim 1, further comprising lock means for locking said plunger member in a fixed axial position relative to said barrel member.

7. In combination with a climber's camming device of the type having a handle and one or more cams carried by the handle which are movable between extended and retracted positions by movement of a release rod axially relative to the longitudinal axis of said handle, an extractor tool comprising:

(a) an elongated barrel member having first and second ends and a longitudinal bore therethrough; said barrel member further including finger grip means;

(b) a plunger member axially movable in said barrel member, said plunger member including a first end adjacent said first end of said barrel member and a second end projecting outwardly from said second end of said barrel member;

(c) hook means carried by said second end of said barrel member for connection to said release rod of said camming device;

(d) lock means for locking said plunger member in a fixed axial position relative to said barrel member;

wherein said hook means engages said release rod and said first end of said plunger member contacts said handle member.

8. A combination in accordance with claim 7, wherein said plunger member is axially aligned with said handle of said camming device.

9. A combination in accordance with claim 7, wherein said finger grip means comprises a shaft secured to said barrel member between said first and second ends thereof and being perpendicular to said barrel member.

10. A combination in accordance with claim 7, wherein said plunger member is biased in the direction of said second end of said barrel member.

11. A combination in accordance with claim 10, wherein said plunger member is biased by means of a spring.

12. An extractor tool for manually extracting a climber's camming device from a crevice, wherein the camming device is of the type having a handle and one or more cams carried by the handle which are movable between extended and retracted positions by movement of a release rod axially relative to the longitudinal axis of said handle; wherein said extractor tool comprises:

(a) an elongated barrel member having first and second ends and a longitudinal bore therethrough; said barrel member further including finger grip means;

(b) a plunger member axially movable in said barrel member, said plunger member including a first end adjacent said first end of said barrel member and a second end projecting outwardly from said second end of said barrel member;

(c) hook means carried by said second end of said barrel member for connection to said release rod of said camming device; and (d) lock means for locking said plunger member in a fixed position relative to said barrel member.

* * * * *